US011798408B2

(12) United States Patent
Wang et al.

(10) Patent No.: US 11,798,408 B2
(45) Date of Patent: Oct. 24, 2023

(54) GREEN WAVE SPEED DETERMINATION METHOD, ELECTRONIC DEVICE AND STORAGE MEDIUM

(71) Applicant: Beijing Baidu Netcom Science Technology Co., Ltd., Beijing (CN)

(72) Inventors: Yile Wang, Beijing (CN); Ning Yang, Beijing (CN); Chuanming Zhang, Beijing (CN)

(73) Assignee: Beijing Baidu Netcom Science Technology Co., Ltd., Beijing (CN)

( * ) Notice: Subject to any disclaimer, the term of this patent is extended or adjusted under 35 U.S.C. 154(b) by 38 days.

(21) Appl. No.: 17/532,407

(22) Filed: Nov. 22, 2021

(65) Prior Publication Data

US 2022/0084400 A1 Mar. 17, 2022

(30) Foreign Application Priority Data

May 31, 2021 (CN) ..... 202110602174.5

(51) Int. Cl.
*G08G 1/01* (2006.01)
*G08G 1/052* (2006.01)
*G08G 1/081* (2006.01)

(52) U.S. Cl.
CPC ..... *G08G 1/0145* (2013.01); *G08G 1/0129* (2013.01); *G08G 1/052* (2013.01); *G08G 1/081* (2013.01)

(58) Field of Classification Search
CPC .... G08G 1/0145; G08G 1/081; G08G 1/0133; G08G 1/052; G08G 1/096725; G08G 1/096
See application file for complete search history.

(56) References Cited

U.S. PATENT DOCUMENTS

2008/0012726 A1* 1/2008 Publicover ..... G08G 1/096725 340/932
2013/0110316 A1* 5/2013 Ogawa ..... G08G 1/096725 701/1
2014/0046581 A1* 2/2014 Ota ..... B60W 40/04 701/408

(Continued)

FOREIGN PATENT DOCUMENTS

CN 105118320 A 12/2015
CN 110164162 A 8/2019

(Continued)

OTHER PUBLICATIONS

First Search Report for CN202110602174.5 dated Feb. 15, 2022 (seven (7) pages).

(Continued)

*Primary Examiner* — Mirza F Alam
(74) *Attorney, Agent, or Firm* — KDW Firm PLLC

(57) ABSTRACT

Provided are a green wave speed determination method, an electronic device and a storage medium, which relates to the field of artificial intelligence, particularly, the field of intelligent traffic technology. The implementation scheme is as follows: a stop position of a vehicle to be detected at an intersection and waiting time of an indicator light at the intersection are acquired; and a green wave speed of the vehicle to be detected is determined according to a traffic condition type, the stop position and the waiting time.

20 Claims, 7 Drawing Sheets

(56) References Cited

U.S. PATENT DOCUMENTS

| | | | | |
|---|---|---|---|---|
| 2020/0242938 | A1* | 7/2020 | Suzuki | G08G 1/052 |
| 2020/0307630 | A1* | 10/2020 | Ueda | B60W 60/0011 |

FOREIGN PATENT DOCUMENTS

| | | | |
|---|---|---|---|
| CN | 110873571 | A | 3/2020 |
| CN | 111721317 | A | 9/2020 |
| CN | 112216105 | A | 1/2021 |
| JP | 2013205177 | A | 10/2013 |
| WO | 2020046187 | A1 | 3/2020 |

OTHER PUBLICATIONS

First Office Action for CN202110602174.5 dated dated Feb. 15, 2022 (32 pages).

* cited by examiner

GREEN WAVE SPEED DETERMINATION METHOD, ELECTRONIC DEVICE AND STORAGE MEDIUM

CROSS-REFERENCE TO RELATED APPLICATIONS

This application claims priority to Chinese patent application No. 202110602174.5 filed with the China National Intellectual Property Administration (CNIPA) on May 31, 2021, the disclosure of which is incorporated herein by reference in its entirety.

TECHNICAL FIELD

The present disclosure relates to the field of artificial intelligence, particularly, the field of intelligent transportation technology and the like, and specifically, a green wave speed determination method, an electronic device and a storage medium.

BACKGROUND

The green wave traffic is that a set of automatically controlled linkage signals having a certain period are installed on a series of flat intersections, so that a traffic flow on the main roads meets the green light when reaching each front intersection in sequence.

The green wave speed estimation is a suggested speed provided for a travelling vehicle after a green wave control is initiated on the road. The traffic capacity of vehicles can be improved to the greatest extent by keeping the green wave speed, and the time for a vehicle to wait for a red light at the flat intersections is reduced.

SUMMARY

The present disclosure provides a green wave speed determination method, an electronic device and a storage medium.

According to the present disclosure, a green wave speed determination method is provided. The green wave speed determination method includes steps described below, a stop position of a vehicle to be detected at an intersection and waiting time of an indicator light at the intersection are acquired; and a green wave speed of the vehicle to be detected is determined according to a traffic condition type, the stop position and the waiting time.

According to the present disclosure, an electronic device is further provided. The electronic device includes at least one processor and a memory communicatively connected to the at least one processor. The memory stores an instruction executable by the at least one processor, and when the instruction is executed by the at least one processor, the at least one processor is caused to perform the green wave speed determination method described in any one of the embodiments of the present disclosure.

According to the present disclosure, a non-transitory computer-readable storage medium storing a computer instruction is further provided. The computer instruction is configured to cause a computer to perform the green wave speed determination method described in any one of the embodiments of the present disclosure.

The accuracy of the green wave speed of the vehicle may be improved in the embodiments of the present disclosure.

It should be understood that the contents described in this section are not intended to identify key or critical features of the embodiments of the present disclosure, nor intended to limit the scope of the present disclosure. Other features of the present disclosure will be readily understood from the following description.

BRIEF DESCRIPTION OF DRAWINGS

The drawings are intended to provide a better understanding of this scheme and are not to be construed as limiting the present disclosure, in which.

DETAILED DESCRIPTION

Exemplary embodiments of the present disclosure are described below with reference to the accompanying drawings, in which various details of embodiments of the present disclosure are included to assist understanding, and which are to be considered as merely exemplary. Therefore, those of ordinary skill in the art will recognize that various changes and modifications of the embodiments described herein may be made without departing from the scope and spirit of the present disclosure. Also, descriptions of well-known functions and structures are omitted in the following description for clarity and conciseness.

Figure 1:
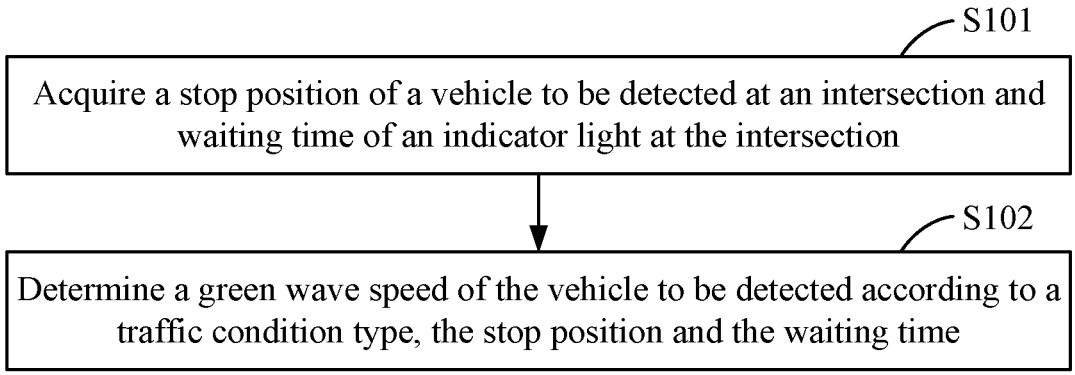
FIG. 1 is a schematic diagram of a green wave speed determination method according to an embodiment of the present disclosure.

FIG. 1 is a flowchart of a green wave speed determination method according to an embodiment of the present disclosure, this embodiment may be applied to the case where a green wave speed of a vehicle passing through the nearest next intersection is determined when the vehicle is travelling. The method provided in this embodiment may be executed by a green wave speed determination apparatus, the apparatus may be implemented by adopting software and/or hardware and is configured in an electronic device with certain data operation capability, and the electronic device may be a client equipment, a mobile phone, a tablet computer, a vehicle-mounted terminal and the like.

In S101, a stop position of a vehicle to be detected at an intersection and waiting time of an indicator light at the intersection is acquired.

The vehicle to be detected is a vehicle approaching to the intersection. The stop position is used for determining the position where the vehicle to be detected stops travelling before reaching the intersection, and the stop travelling may be a state where the vehicle speed is 0. Typically, in a clear traffic application scenario, the vehicle will stop at the stop line. In a congestion traffic application scenario, the vehicle stops at the tail of the vehicle queue instead of stopping at the stop line. In fact, different traffic application scenarios determine different stop positions. In general, the stop position may refer to a position between the intersection and the vehicle to be detected. The waiting time of the indicator light at the intersection is used for determining the time for the vehicle to be detected to travel to the intersection, and in an embodiment, the waiting time of the indicator light at the intersection is for determining how long the vehicle to be detected needs to reach the intersection. The waiting time of the indicator light at the intersection may include a countdown of the indicator light at the intersection and/or a timing period of the indicator light at the intersection. The indicator light at the intersection includes at least one of a left-turning indicator light, a straight-travelling indicator light, a right-turning indicator light, etc., where the left-turning indicator light and the straight-travelling indicator light may refer to the same indicator light. The indicator light at the intersection includes an indicator light in at least one direction, and the direction of the indicator light corresponds to a travel direction of the vehicle, thus the waiting time of the indicator light at the intersection corresponds to the travel direction of the vehicle.

In S102, a green wave speed of the vehicle to be detected is determined according to a traffic condition type, the stop position and the waiting time.

The traffic condition type may refer to the type of a traffic application scenario. The traffic condition type may include a clear traffic type or a congestion traffic type. The clear traffic type may refer to a traffic condition without a vehicle queuing, and the vehicle to be detected may reach the intersection without stopping and pass through the intersection. The congestion traffic type may refer to a traffic situation where vehicles are queued, and the vehicle to be detected may need to wait in line to pass through the intersection. The green wave speed is used for indicating a speed at which the vehicle to be detected passes through the intersection. The traffic condition type corresponds to a calculation mode of the green wave speed, namely, different traffic condition types correspond to different calculation modes of the green wave speed. The stop position and the waiting time are used based on a calculation mode corresponding to the traffic condition type to calculate the green wave speed.

In the related art, the current position of the vehicle is acquired, the next straight-travelling intersection of the current position is traced forward, information such as a countdown and a timing period of a traffic light is acquired, and the green wave speed is calculated based on the time of the traffic light and a path distance of the vehicle to the next intersection. In this manner, the green wave speed under the straight-travelling scenario is mainly considered, and the calculation of the green wave model is idealized and divorced from the practical application, a road distance of only two intersections has been considered, however, the problem that stop lines of vehicles are different under different scenarios that the vehicles are clear or congestion is not considered, resulting in the insufficient calculation accuracy.

In the technical scheme of the present disclosure, different traffic condition types correspond to different stop positions, different travel directions correspond to different waiting time of the indicator light at the intersection, therefore, the corresponding stop position and the waiting time of the indicator light at the intersection may be determined for an application scenario, so as to calculate a green wave speed adapted to this application scenario, enrich the applicable scenario range of the green wave speed, and improve the accuracy of the green wave speed.

According to the technical scheme of the present disclosure, the green wave speed of the vehicle to be detected is determined according to the traffic condition type of the intersection, the stop position of the vehicle to be detected at the intersection and the waiting time of the indicator light at the intersection, the green wave speed may be calculated for different traffic application scenarios, green wave speeds under different traffic application scenarios may be distinguished, different traffic application scenarios may be adapted, the green wave speed which is more in line with an actual traffic application scenario may be calculated, the calculation accuracy of the green wave speed is improved, and thus the red light waiting time of the vehicle is shortened.

Figure 2:
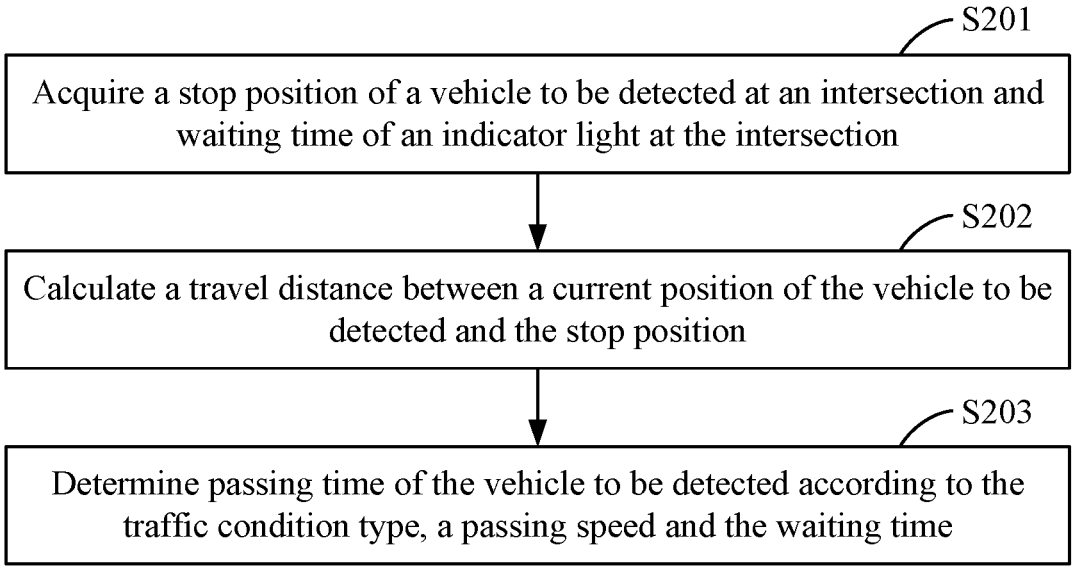
FIG. 2 is a schematic diagram of a green wave speed determination method according to an embodiment of the present disclosure.

FIG. 2 is a flowchart of another green wave speed determination method disclosed according to an embodiment of the present disclosure, which is further optimized and expanded based on the above technical scheme and may be combined with the above optional implementations. The step in which the green wave speed of the vehicle to be detected is determined according to the traffic condition type, the stop position and the waiting time is described as follows: a travel distance between the current position of the vehicle to be detected and the stop position is calculated; passing time of the vehicle to be detected is determined according to the traffic condition type, a passing speed and the waiting time; and the green wave speed of the vehicle to be detected is calculated according to the travel distance and the passing time.

In S201, a stop position of a vehicle to be detected at an intersection and waiting time of an indicator light at the intersection is acquired.

Similar or identical features may be referred to the foregoing description.

In S202, a travel distance between a current position of the vehicle to be detected and the stop position is calculated.

The position is usually represented by latitude and longitude information. The current position of the vehicle to be detected refers to longitude and latitude information of the position where the vehicle to be detected is located. The current position of the vehicle to be detected may be obtained by positioning the vehicle to be detected in real-time. Exemplarily, when the vehicle to be detected uses a map service or a navigation service, self-positioning data of the vehicle to be detected needs to be provided, so the self-positioning data may be acquired and the current position of the vehicle to be detected may be determined. The travel distance refers to a distance between the current position and the stop position and is used for determining a distance at which the vehicle to be detected may travel clearly, that is, the distance at which the vehicle to be detected passes through clearly or the distance at which the vehicle to be detected travels without stopping.

In S203, passing time of the vehicle to be detected is determined according to the traffic condition type, a passing speed and the waiting time.

The passing time may refer to the time in which the vehicle to be detected may pass through the stop position. The passing speed may refer to a travel speed of the vehicle to be detected in a position range corresponding to the traffic condition type. The passing speed is different under different traffic condition types. For example, for the congestion traffic type, a vehicle queuing queue exists at the intersection, the speed of each vehicle is slow, and the speed of the vehicle to be detected passing through the queuing queue is a passing speed under the congestion traffic type; for the clear traffic type, no vehicle queuing exists at the intersection, vehicles may pass through quickly, and the preset maximum speed of the vehicle to be detected is a passing speed under the clear traffic type. Correspondingly, the passing speed under the congestion traffic type is less than the passing speed under the clear traffic type. The waiting time is determined according to a travel direction of the vehicle to be detected.

Generally, in the congestion traffic type, the vehicle queuing queue exists, and the passing time of the vehicle to be detected is related to the waiting time and the time to pass through the queuing queue determined according to the length of the queuing queue and the passing speed of the vehicle passing through the queuing queue, that is, the time for the vehicle to be detected to pass through the queuing queue is determined according to the length of the queuing queue and the passing speed of the vehicle passing through the queuing queue, and then the passing time of the vehicle to be detected is determined according to the time and the waiting time. That is, the vehicle to be detected may pass through the queuing queue clearly as long as the vehicle to be detected finishes the travel distance within the passing time, so that the vehicle to be detected may reach the intersection within the waiting time and pass through the intersection clearly.

Moreover, in the clear traffic type, no vehicle queuing queue exists, and the passing time of the vehicle to be detected is related to the waiting time, that is, the passing time of the vehicle to be detected is determined according to the waiting time.

In fact, passing time determination manners of the vehicle to be detected corresponding to different traffic condition types are different. In different traffic condition types, the passing time of the vehicle to be detected is determined by selecting different information correspondingly. Different traffic condition types can be accurately adapted, the passing time is calculated, and the calculation accuracy of the passing time is improved.

In an embodiment, the step in which the passing time of the vehicle to be detected is determined according to the traffic condition type, the passing speed and the waiting time includes: in the case where the traffic condition type is the congestion traffic type, a pre-counted queuing passing speed is determined as the passing speed; a queuing length between the stop position and the intersection is acquired; and the passing time of the vehicle to be detected is calculated according to the waiting time, the queuing length and the queuing passing speed.

The queuing passing speed is a speed of the vehicle passing through the queuing queue. Exemplarily, a difference value may be calculated by collecting a starting moment of each vehicle at a certain position in the queuing queue and an ending moment of the vehicle reaching the stop line at the intersection under the congestion traffic type, and the difference value is determined as the time for the vehicle to pass through the queuing queue. A ratio of a distance between the certain position and the position of the stop line to the calculated time is calculated and determined as the speed of the vehicle passing through the queuing queue. Speeds of a large number of vehicles passing through the queuing queue may be counted, and a mean value is counted and determined as the queuing passing speed. The queuing length may refer to a length of the vehicle queuing queue at the intersection. A length between a position of a vehicle at the tail of the queuing queue and the stop line at the intersection under the congestion traffic type may be collected. A large number of lengths may be counted, and a mean value is counted and determined as the queuing length. Alternatively, a distance between the stop line and the position of the vehicle at the tail of the queuing queue at the intersection in real time may also be determined as the queuing length. A ratio between the queuing length and the queuing passing speed is calculated and determined as the queuing time, and a difference value between the queuing time and a sum of a timing period and a countdown is calculated and determined as the passing time. In fact, the waiting time consists of two parts, i.e., time for the vehicle to be detected to pass through the queuing length and the passing time. The vehicle to be detected passes through the intersection within the waiting time, which represents that the vehicle to be detected needs to pass through the queuing length within the time for passing through the queuing length and the travel distance within the passing time. The vehicle to be detected may pass through the queuing length at the queuing passing speed, which represents that the vehicle to be detected may pass through the queuing length within the time determined according to the queuing passing speed. Correspondingly, the time for passing through the queuing queue is excluded from the waiting time to obtain the passing time, and the green wave speed is calculated according to the passing time and the travel distance, so that the vehicle to be detected can pass through the travel distance at the green wave speed, and the vehicle to be detected can pass through the queuing length within the remaining time. Therefore, the vehicle to be detected can pass through the intersection at the green wave speed.

Figure 3:
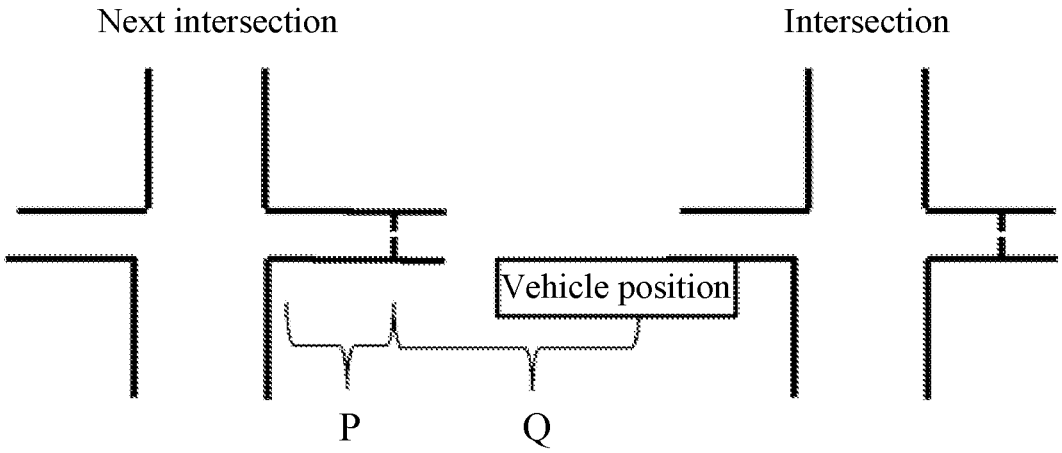
FIG. 3 is a schematic diagram of a stop position in a congestion traffic type according to an embodiment of the present disclosure.

In one example, as shown in FIG. 3, the intersection in FIG. 3 refers to an intersection where the vehicle to be detected has passed through in the embodiments of the present disclosure, the next intersection in FIG. 3 refers to the intersection described in the embodiments of the present disclosure, a vehicle position is the current position of the vehicle to be detected, and P is the queuing length; Q is the distance between the stop position and the current position of the vehicle to be detected; the timing period=N seconds; the countdown=M seconds; the next period R=M+N; the queuing passing speed=S; the passing time=(R−P/S); then the green wave speed=Q/(R−P/S).

For the congestion traffic type, the time for the vehicle to be detected to pass through the queuing queue is calculated. According to the waiting time, the time for passing through the queuing queue is excluded from the waiting time to obtain the passing time, and the passing time under the congestion traffic type is calculated according to information of the queuing queue, so that the time for the vehicle to be detected to pass through the travel distance may be accurately determined, and thus the green wave speed under the congestion traffic type can be accurately calculated.

In an embodiment, the step in which the passing time of the vehicle to be detected is determined according to the traffic condition type, the passing speed and the waiting time includes: in the case where the traffic condition type is the clear traffic type, the pre-configured maximum passing speed is determined as the passing speed; a ratio of the travel distance to the maximum passing speed is calculated, where the waiting time includes a countdown and a timing period of the indicator light; in the case where the ratio is less than or equal to the countdown, the countdown is determined as the passing time of the vehicle to be detected; or in the case where the ratio is greater than the countdown, a sum of the countdown and the timing period of the indicator light is determined as the passing time of the vehicle to be detected.

The maximum passing speed may refer to the maximum speed that the vehicle to be detected may reach. The maximum passing speed may be determined according to the mode of the vehicle to be detected and a correspondence between the mode and the maximum passing speed, exemplarily, when the vehicle to be detected is in a safety mode, the corresponding maximum passing speed is 60 km/h; and when the vehicle to be detected is not in the safety mode or in a normal mode, the corresponding maximum passing speed is 100 km/h. The countdown may be the time between the current moment and a moment when the indication of the target indicator light ends. The timing period of the indicator light is the time between a moment when the indication of the target indicator light ends and a moment when the indication of the target indicator light starts. When the ratio is less than or equal to the countdown, it represents that the vehicle to be detected may pass through the travel distance within the time of the countdown at the maximum passing speed, that is, a passing indicator light (such as the green light) is displayed when the vehicle to be detected reaches the intersection within the countdown, so that the vehicle to be detected may pass through the intersection within the time of the countdown, and at this time, the green wave speed may be calculated according to the time of the countdown. When the ratio is greater than the countdown, it represents that the vehicle to be detected cannot pass through the travel distance within the time of the countdown at the maximum passing speed, so that the vehicle to be detected cannot pass through the intersection within the time of the countdown, that is, a stop-passing indicator light (such as the yellow light or red light) is displayed when the vehicle to be detected reaches the intersection within the countdown, and at this time, the vehicle to be detected may meet the passing indicator light (such as the green light) after one timing period, and the calculation of the green wave speed may be calculated according to the sum of the countdown and the timing period.

Figure 4:
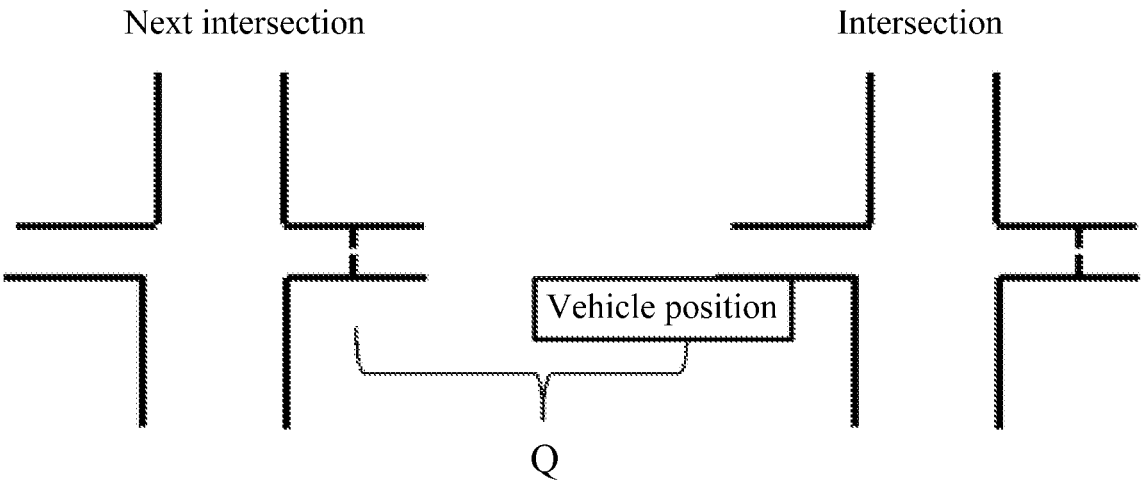
FIG. 4 is a schematic diagram of a stop position in a clear traffic type according to an embodiment of the present disclosure.

In one example, as shown in FIG. 4, the intersection in FIG. 4 refers to an intersection where the vehicle to be detected has passed through in the embodiments of the present disclosure, the next intersection in FIG. 4 refers to an intersection described in the embodiments of the present disclosure, a vehicle position is the current position of the vehicle to be detected, and Q is the distance between the stop position and the current position of the vehicle to be detected; the timing period=N seconds; the countdown=M seconds; the next period R=M+N; and the maximum passing speed=U.

If Q/U<M; it represents that the vehicle to be detected may pass through in the current period, the passing time=M, and the green wave speed=Q/M; if Q/U>M, it represents that the vehicle to be detected cannot pass through in the current period and may pass through in the next traffic light period, the passing time=R=M+N, and the green wave speed=Q/(M+N).

For the clear traffic type, the ratio of the travel distance to the maximum passing speed is calculated, whether the vehicle to be detected may pass through the intersection within the current countdown of the indicator light is determined according to a comparison result between the ratio and the countdown, thus the passing time corresponding to the comparison result is determined, the passing time under the clear traffic type is accurately calculated, and the time for the vehicle to be detected to finish the travel distance can be accurately determined so that the green wave speed under the clear traffic type can be accurately calculated.

In S204, a green wave speed of the vehicle to be detected is calculated according to the travel distance and the passing time.

The travel distance is a distance of the vehicle to be detected to the stop position, and the passing time is time that the vehicle to be detected may pass through the stop position, and in fact, the vehicle to be detected may pass through the travel distance, which represents that the vehicle to be detected may pass through the stop position, so that the passing time is available time for the vehicle to be detected to pass through the travel distance. The green wave speed is a suggested speed of the vehicle to be detected passing through the stop position. In fact, the vehicle to be detected may clearly pass through the intersection after the vehicle to be detected finishes the travel distance within the passing time, so that a speed at which the vehicle to be detected finishes the travel distance within the passing time may be determined as the green wave speed. The ratio of the travel distance to the passing time may be calculated and determined as the green wave speed.

According to the technical scheme of the present disclosure, the passing time under different traffic condition types is determined according to the traffic condition type, the passing speed and the waiting time, and the speed of the vehicle to be detected passing through the stop position may be determined as the green wave speed according to the passing time and the travel distance between the vehicle to be detected and the stop position, so that different traffic condition types are accurately adapted, the passing time is calculated, and the calculation accuracy of the passing time is improved.

Figure 5:
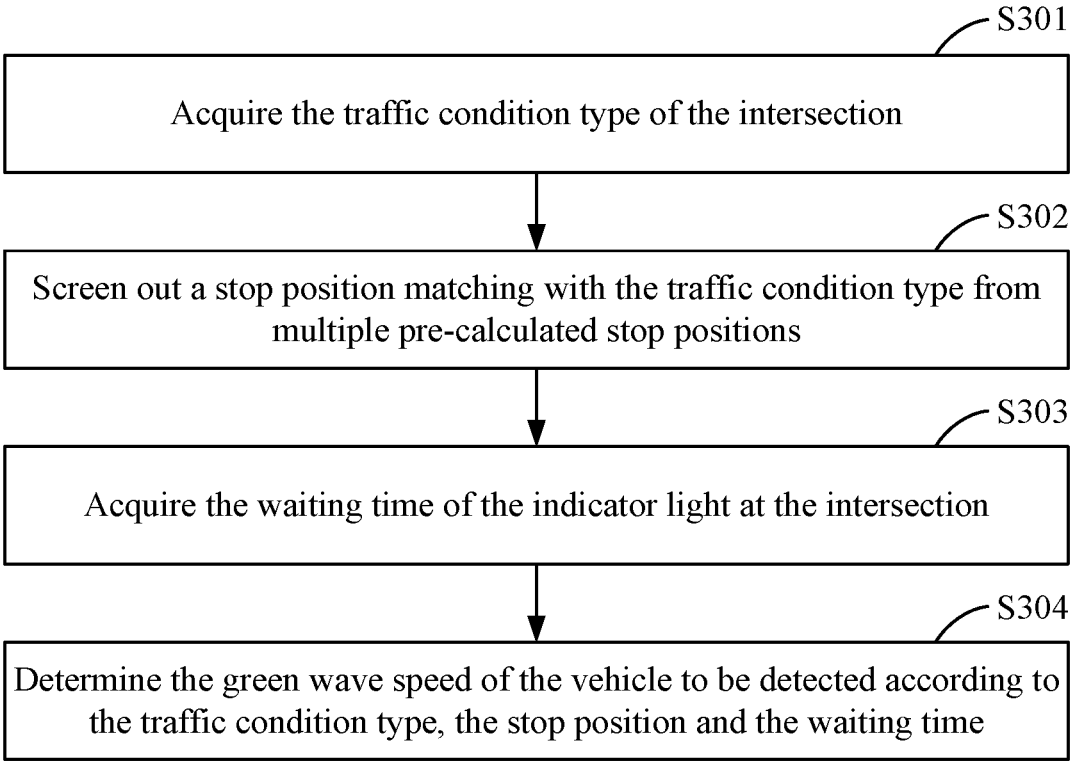
FIG. 5 is a schematic diagram of a green wave speed determination method according to an embodiment of the present disclosure.

FIG. 5 is a flowchart of another green wave speed determination method disclosed according to an embodiment of the present disclosure, which is further optimized and expanded based on the above technical schemes and may be combined with the above alternative implementations. The step in which the stop position of the vehicle to be detected at the intersection is acquired includes: the traffic condition type of the intersection is acquired; and a stop position matching with the traffic condition type is screened out from multiple pre-calculated stop positions.

In S301, the traffic condition type of the intersection is acquired.

Similar or identical features may be referred to the foregoing description.

The traffic condition type of the intersection may be detected according to information such as congestion information of the intersection provided by a user or map service, travel data of vehicles at the intersection, and an intersection image acquired in real time. Exemplarily, the traffic condition type may be determined according to whether a vehicle queuing queue exists in the image acquired by a roadside equipment, for example, the congestion traffic type is determined when a distance between adjacent vehicles in the same lane is detected to be less than or equal to a set distance threshold value in the image; and the clear traffic type is determined when the distance between adjacent vehicles in the same lane is detected to be greater than a set distance threshold value in the image. The traffic condition type is determined according to the travel speed of the vehicle, for example, the congestion traffic type is determined when the travel speed of the vehicle is less than or equal to a set speed threshold value; and the clear traffic type is determined when the travel speed of the vehicle is greater than the set speed threshold value.

In S302, a stop position matching with the traffic condition type is screened out from multiple pre-calculated stop positions.

Figure 6:
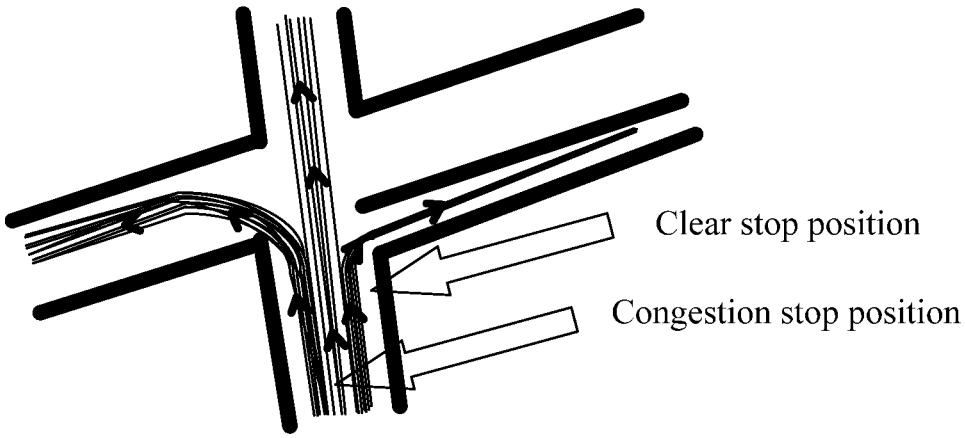
FIG. 6 is a schematic diagram of a stop position at an intersection according to an embodiment of the present disclosure.

The stop position is calculated offline. There is a correspondence between the stop position and the traffic condition type. Different traffic condition types correspond to different stop positions. A corresponding stop position may be screened according to the traffic condition type. In one example, as shown in FIG. 6, vehicles coming below turn left and right and travel straight respectively, at the intersection, and the thin line in FIG. 6 is the collection of travel trajectories of multiple vehicles. The arrows show the stop position in the clear traffic type and the stop position in the congestion traffic type, and a distance between the stop position in the clear traffic type and the intersection is less than a distance between the stop position in the congestion traffic type and the intersection.

In an embodiment, the step in which the stop position matching with the traffic condition type is screened out includes: in the case where the traffic condition type is the clear traffic type, the stop position is screened out according to a predicted travel direction of the vehicle to be detected, and the stop position is determined as the stop position matching with the traffic condition type.

In the clear traffic type, stop positions of vehicles to be detected in different travel directions are different. Generally, the stop position refers to a position at which the vehicle to be detected is suspected to be stopped and may be represented by a position of a key point in a travel process of the vehicle, and the key point may refer to a position point where the speed of the vehicle changes. For example, the key point for the straight travelling may be a position of the lowest speed point; the key point for turning (left turning or right turning) may be a position of a point with the largest change in the speed direction. The position of the key point may be determined by historical statistics of speed points of the vehicle in different travel directions and used as the stop position.

In the clear traffic type, the corresponding stop position is further accurately determined according to the vehicle travel direction, and diversified traffic application scenarios can be satisfied.

Furthermore, in the case where the traffic condition type is the congestion traffic type, a stop position matching with the congestion traffic type is queried and determined as the stop position matching with the traffic condition type.

In an embodiment, the green wave speed determination method further includes steps described below, path sequences of historical vehicles passing through the intersection are acquired; the path sequences are divided according to the traffic condition type to form a clear path sequence set and a congestion path sequence set; a queue tail position of a vehicle queuing queue corresponding to a path sequence included in the congestion path sequence set is acquired, and a stop position matching with the congestion traffic type is determined; a path sequence in the clear path sequence set is divided according to a historical travel direction of the path sequence included in the clear path sequence set, in the path sequence corresponding to the historical travel direction, a key point of the historical travel direction is determined, and a position of the key point is determined as the stop position matching with the clear traffic type.

Figure 7:
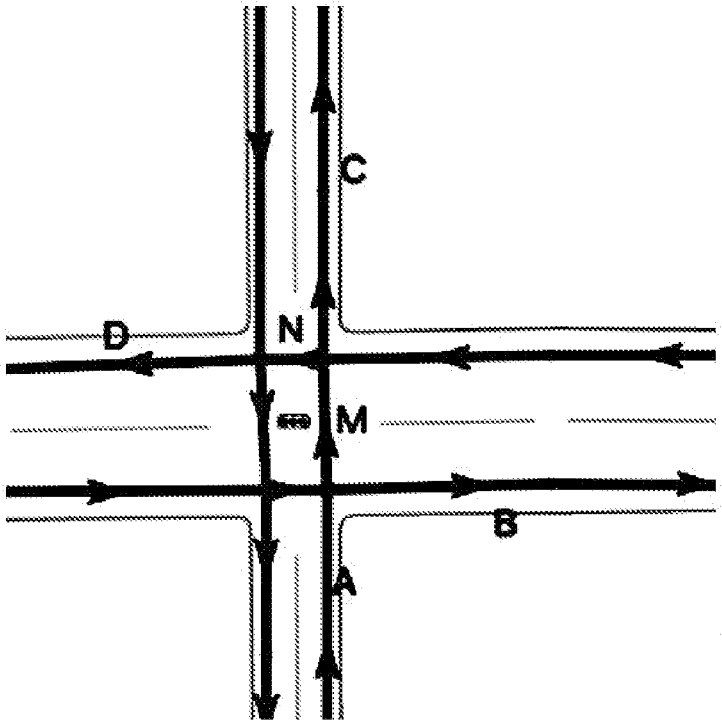
FIG. 7 is a schematic diagram of a path sequence according to an embodiment of the present disclosure.

Typically, route data is represented by the road segment (Link), and one route may be represented by a link sequence, multiple link identifiers in the link sequence are arranged in a sequential order of links in the route. In one example, as shown in FIG. 7, a left-turning path sequence is A_M_N_D; a straight-travelling path sequence is A_M_C, and a right-turning path sequence is A_B. It should be noted that each path sequence is formed by connecting multiple discrete points.

Dividing the path sequence according to the traffic condition type may refer to dividing the path sequence according to a traffic condition type where a vehicle using the path sequence as a travel route is located at that time.

The queue tail position of the vehicle queuing queue corresponding to the path sequence included in the congestion path sequence set refers to an acquired queue tail position of the vehicle queue at the intersection in the process of the vehicle travelling along the path sequence. In the travel process, multiple queue tail positions may be obtained, and a queue tail position with the longest distance to the intersection is selected and determined as the queue tail position of the vehicle queuing queue corresponding to the path sequence. Exemplarily, multiple path sequences are acquired to respectively extract a queue tail position, and the stop position is determined, for example, an average of the multiple queue tail positions may be calculated to determine the stop position. Travel directions are not distinguished in the congestion path sequence set.

In the clear path sequence set, the path sequence is divided into a path sequence set of a left-turning travel direction, a path sequence set of a right-turning travel direction or a path sequence set of a straight-travelling direction according to the historical travel direction of the included path sequence. The key point of the travel direction may refer to a speed point at which the speed of the vehicle changes in this travel direction. For example, the key point for the straight travelling may be a position of the lowest speed point; the key point for the turning (turning left or turning right) may be a position of a point with the largest change in the speed direction. Exemplarily, multiple path sequences are acquired to respectively extract the position of the key point, and the stop position is determined, for example, an average of the positions of the multiple key points may be calculated to determine the stop position.

Figure 8:
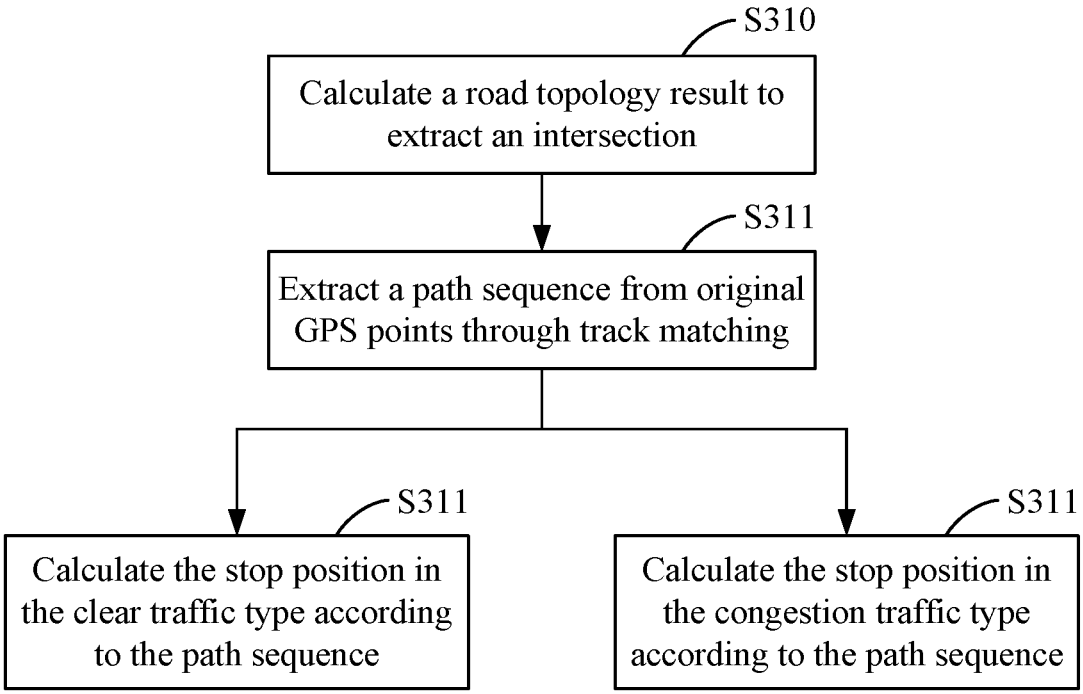
FIG. 8 is a schematic diagram of a stop position determination method according to an embodiment of the present disclosure.

In one example, as shown in FIG. 8, a stop position determination method includes steps described below.

In S310, a road topology result is calculated to extract an intersection.

Intersections are sequentially extracted in a construction result of a road topological structure according to the pre-established road topological structure, and the stop position is calculated for each intersection.

In S311, a path sequence is extracted from original global positioning system (GPS) points through track matching.

When a vehicle passes through an intersection, real-time positioning points provided based on the GPS service may be acquired, the positioning points are connected to form a track, and the path sequence corresponding to the track is determined by adopting the track matching.

Figure 9:
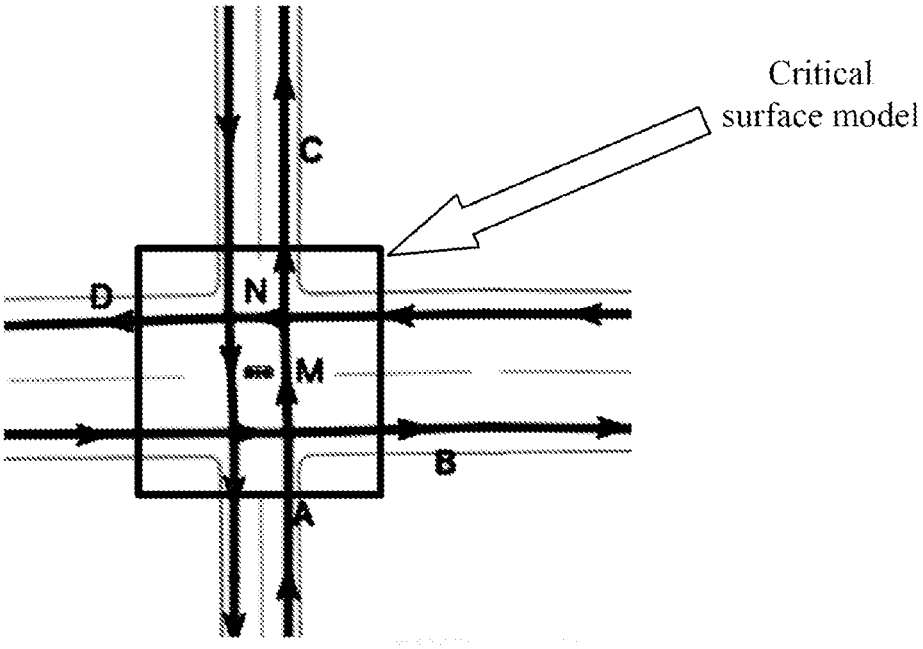
FIG. 9 is a schematic diagram of a critical surface model according to an embodiment of the present disclosure.

The length of the track is not unlimitedly extended. A critical surface model may be pre-defined: all tracks of 100 meters forward and backward of the intersection are determined as required path sequences, and a path sequence set is formed. In one example, as shown in FIG. 9, the critical surface model is path sequences within a range of the middle region (box in FIG. 9). Assuming that all links are long enough, a reasonable left-turning path sequence in FIG. 7 is A_M_N_D. In general, a total length of the critical surface to the top is a distance of the critical surface to the head of linkA, in meters; a total length of the critical surface to the tail is a distance of the critical surface to the tail of linkD, in meters; the number of tracks included in the critical surface model is at least 30, and in an embodiment, the number of tracks included in the critical surface model is at least 200.

In S312, the stop position in the clear traffic type is calculated according to the path sequence.

In S313, the stop position in the congestion traffic type is calculated according to the path sequence.

The path sequences are classified according to the traffic condition type, and different manners are selected to calculate the stop position for the classified sets, stop positions in different traffic condition types can be accurately distinguished, determination manners of the stop positions may be subdivided, and diversified traffic application scenarios can be satisfied.

In an embodiment, the step in which the key point of the historical travel direction is determined includes: in the case where the historical travel direction is turning, a gradient of each position point in the path sequence is calculated, and a position point with the maximum gradient is determined as the key point for the turning; in the case where the historical travel direction is straight travelling, a travel speed of a road segment between two adjacent position points in the path sequence is acquired; and one of two position points between which the travel speed is minimum is selected as the key point for the straight travelling.

In the case of turning, the change in the speed of the vehicle is mainly reflected by the change in a turning angle, and at this time, the key point generally refers to a position point at which the change in the turning angle is the largest. The gradient of the position point refers to a direction in which the turning angle changes fastest. An absolute value of the gradient of the position point is a speed at which the turning angle changes in that direction. The gradient of the position point may be directly calculated according to a gradient formula, or the gradient of a point with the foremost travel sequence in a group may be determined according to the change in an angle between a line segment determined by two adjacent points in the group and a line segment determined by two adjacent points in the next group in the track according to the travel sequence. The point with the maximum gradient is determined as the key point of the travel direction of the turning. The determination manner of the key point of the travel direction of the left turning is the same as the determination manner of the key point of the travel direction of the right turning.

In the case of straight travelling, the change in speed of the vehicle is mainly reflected by a change in the speed. At this time, the key point generally refers to a position point at which the speed is the smallest. One of two position points in a road segment with the lowest travel speed is selected as the key point for the straight travelling. In an embodiment, the last position point in the travel sequence may be selected to be determined as the key point for the straight travelling.

Different travel directions are distinguished and positions of different key points are configured for different travel directions, positions of key points in different travel directions can be accurately distinguished, determination manners of the key points are subdivided, and diversified traffic application scenarios can be satisfied.

In S303, the waiting time of the indicator light at the intersection is acquired.

In S304, the green wave speed of the vehicle to be detected is determined according to the traffic condition type, the stop position and the waiting time.

According to the technical scheme of the present disclosure, different traffic condition types are configured to match with different stop positions, and the stop position is pre-calculated, the acquisition efficiency of the stop position can be improved, the calculation efficiency of the green wave speed can be improved, the green wave speed can be accurately calculated while different traffic condition types are distinguished, and the calculation accuracy of the green wave speed can be improved.

Figure 10:
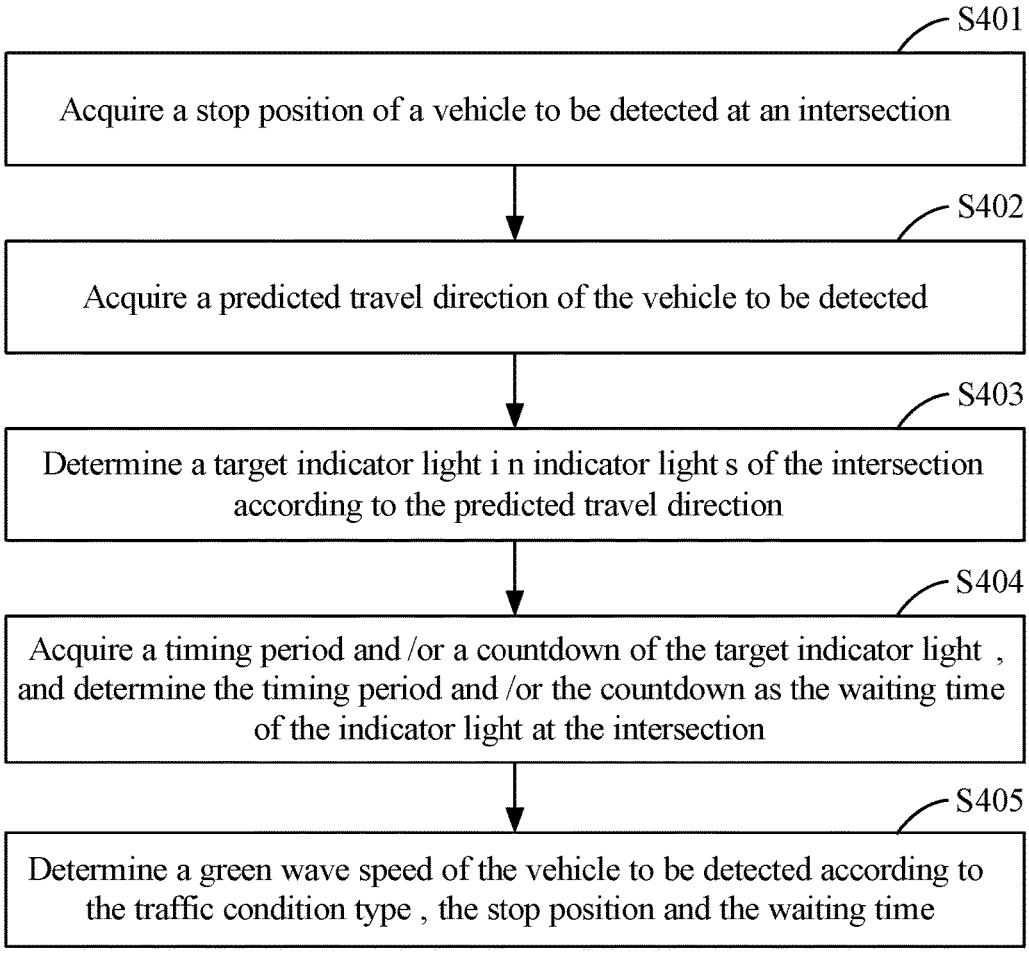
FIG. 10 is a schematic diagram of a green wave speed determination method according to an embodiment of the present disclosure.

FIG. 10 is a flowchart of another green wave speed determination method disclosed according to an embodiment of the present disclosure, which is further optimized and expanded based on the above technical schemes and may be combined with the above various alternative implementations. The step in which the waiting time of the indicator light at the intersection is acquired includes: a predicted travel direction of the vehicle to be detected is acquired; a target indicator light in indicator lights of the intersection is determined according to the predicted travel direction; a timing period and/or a countdown of the target indicator light is acquired, and the timing period and/or the countdown is determined as the waiting time of the indicator light at the intersection.

In S401, a stop position of a vehicle to be detected at an intersection is acquired.

In S402, a predicted travel direction of the vehicle to be detected is acquired.

Figure 11:
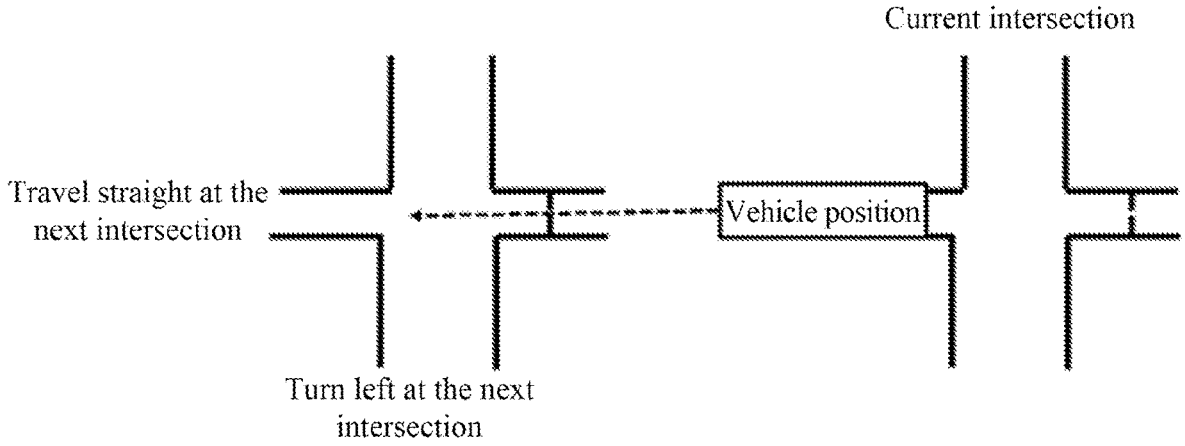
FIG. 11 is a schematic diagram of a predicted travel direction application scenario according to an embodiment of the present disclosure.

The predicted travel direction may refer to a travel direction of the vehicle to be detected in the process of passing through the intersection. Generally, the travel direction includes left turning, right turning, straight travelling or left-rear turning, etc. In an example, as shown in FIG. 11, the predicted travel direction at the next intersection needs to be predicted just when the vehicle to be detected passes through the current intersection, where the next intersection in the figure is the intersection described in the embodiments of the present disclosure.

In an embodiment, the step in which the predicted travel direction of the vehicle to be detected is acquired includes: historical tracks of the vehicle to be detected passing through the intersection are acquired, and travel directions of the historical tracks are determined; numbers of times that the vehicle to be detected passes through the intersection in different travel directions are counted according to the travel directions of the historical tracks, and a weight of each travel direction is determined; and the predicted travel direction of the vehicle to be detected is determined according to the weight of each travel direction.

The historical track refers to a track in which the vehicle to be detected travels from a certain road segment, passes through the intersection, and leaves to another road segment. The travel directions of the historical tracks are determined based on the coming road segments and the leaving road segments of the historical tracks, for example, as shown in FIG. 7, a vehicle using the path sequence A_M_N_D as the travel route travels from road segment A to road segment D, and the travel direction is left turning on road segment A. Numbers of times that the vehicle to be detected passes through the intersection in different travel directions refer to the number of times that the vehicle to be detected travels in each travel direction. The travel direction includes the coming road segment, and the travel directions are different when the vehicle travels from different road segments even if the same left turning.

The weight may refer to frequencies of the vehicle to be detected in different travel directions, and the weight is used for determining an optimal possible travel direction of the vehicle to be detected. An accumulated sum may be calculated according to the counted times of each travel direction, and the weight of the travel direction is determined according to a ratio of the times of each travel direction to the accumulated sum. Exemplarily, for intersection N, the weight of the left turning is 0.9, the weight of the straight travelling is 0.7, and the weight of the right turning is 0.2. The determination of the predicted travel direction of the vehicle to be detected according to the weight of each travel direction may be that a travel direction with the largest weight is selected to be determined as the predicted travel direction.

In an embodiment, an actual travel direction of the vehicle to be detected when the vehicle to be detected passes through the intersection may be counted, and the weight may be corrected when the actual travel direction is different from the predicted travel direction. For example, the weight corresponding to the predicted travel direction may be reduced, exemplarily, reduced by 0.1. The weight of the predicted travel direction is corrected by acquiring the actual travel direction so that the prediction accuracy can be improved.

Figure 12:
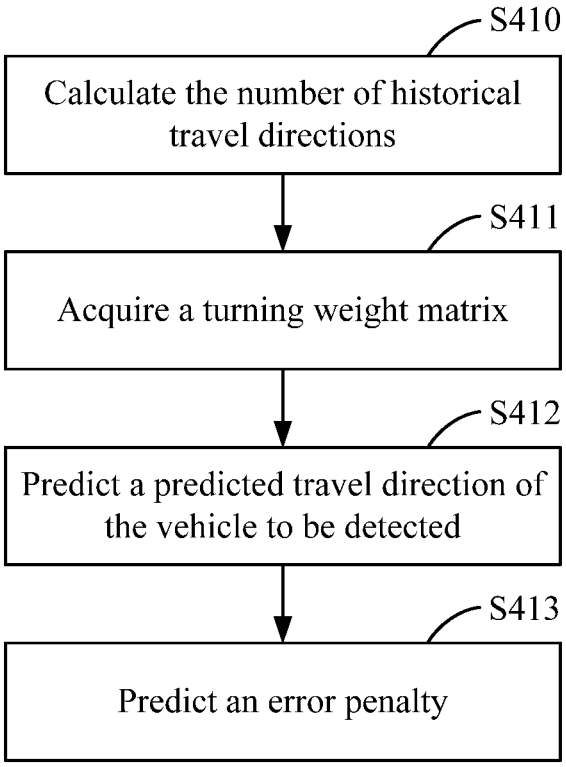
FIG. 12 is a schematic diagram of a predicted travel direction determination method according to an embodiment of the present disclosure.

In one example, as shown in FIG. 12, the predicted travel direction determination method includes steps described below.

In S410, the number of historical travel directions is calculated.

In S411, a turning weight matrix is acquired.

The turning weight matrix is generated according to the number of historical travel directions.

The turning weight matrix refers to a matrix formed by weights of the vehicle to be detected in all travel directions.

In S412, a predicted travel direction of the vehicle to be detected is predicted.

In S413, an error penalty is predicted.

The prediction of the error penalty refers to the correction of the weight in the case where the actual travel direction is different from the predicted travel direction.

The travel directions of the historical tracks of the vehicle to be detected are counted, the number of occurrence times of each travel direction is recorded, the weight is calculated, and the predicted travel direction is determined according to the weight. The predicted travel direction may be determined according to the historical behavior of the vehicle to be detected, and the prediction accuracy of the predicted travel can be improved.

In S403, a target indicator light in indicator lights of the intersection is determined according to the predicted travel direction.

Generally, the indicator light at the intersection includes at least one indicator light, and the target indicator light corresponds to the predicted travel direction. The predicted travel direction is the left turning, the target indicator light is a left-turning indicator light, and the indicator light at the intersection may include only one indicator light that is a combination of the left-turning indicator light and the straight-travelling indicator light. The predicted travel direction is the right turning, the target indicator light is a right-turning indicator light, and the indicator light at the intersection may include no right-turning indicator light. The predicted travel direction is the straight travelling, and the target indicator light is the straight-travelling indicator light. The predicted travel direction is the left rear turning, and the target indicator light is the left-turning indicator light, left-rear-turning indicator light, or the like.

In S404, a timing period and/or a countdown of the target indicator light is acquired, and the timing period and/or the countdown is determined as the waiting time of the indicator light at the intersection.

The timing period of the target indicator light is the time between a moment when the indication of the target indicator light ends and a moment when the indication of the next indication starts, that is, the duration of the interval between two times of the indication. The countdown is the time between the current moment and the moment when the indication of the target indicator light ends.

In S405, a green wave speed of the vehicle to be detected is determined according to the traffic condition type, the stop position and the waiting time.

According to the technical scheme of the present disclosure, the predicted travel direction of the vehicle to be detected is acquired, the target indicator light and the timing period and/or countdown of the target indicator light are determined, and the timing period and/or countdown of the target indicator light is determined as the waiting time of the indicator light at the intersection, the green wave speed can be accurately calculated while different predicted travel directions are distinguished, the calculation accuracy of the green wave speed is improved, and meanwhile, the determination manners of the stop positions can be subdivided, and the diversified traffic application scenarios can be satisfied.

Figure 13:
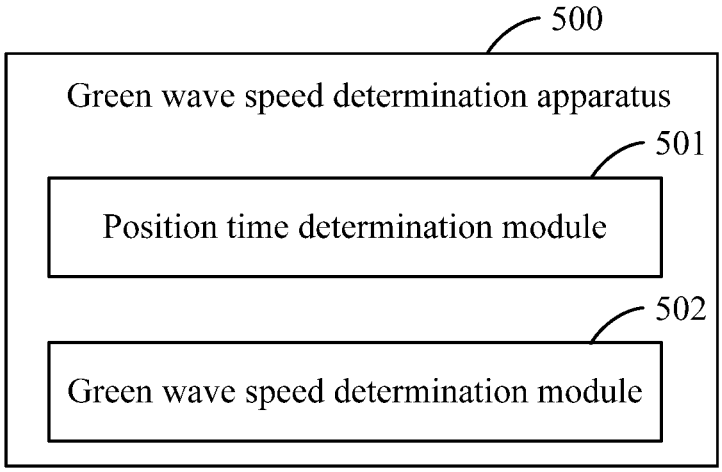
FIG. 13 is a schematic diagram of a green wave speed determination apparatus according to an embodiment of the present disclosure.

According to an embodiment of the present disclosure, FIG. 13 is a structural diagram of a green wave speed determination apparatus in an embodiment of the present disclosure, and the embodiment of the present disclosure applies to the case where a green wave speed of a vehicle passing through the nearest next intersection is determined during a travel process of the vehicle. The apparatus is implemented by adopting software and/or hardware and is configured in an electronic device with certain data operation capacity.

A green wave speed determination apparatus 500 as shown in FIG. 13 includes a position time determination module 501 and a green wave speed determination module 502.

The position time determination module 501 is configured to acquire a stop position of a vehicle to be detected at an intersection and waiting time of an indicator light at the intersection.

The green wave speed determination module 502 is configured to determine a green wave speed of the vehicle to be detected according to a traffic condition type, the stop position and the waiting time.

According to the technical scheme of the present disclosure, the green wave speed of the vehicle to be detected is determined according to the traffic condition type of the intersection, the stop position of the vehicle to be detected at the intersection, and the waiting time of the indicator light at the intersection, a green wave speed may be calculated for different traffic application scenarios, green wave speeds under different traffic application scenarios may be distinguished, different traffic application scenarios may be adapted, the green wave speed which is more in line with an actual traffic application scenario may be calculated, the calculation accuracy of the green wave speed is improved, and thus the red light waiting time of the vehicle is shortened.

Further, the green wave speed determination module includes a travel distance calculation unit, a passing time calculation unit and a green wave speed calculation unit. The travel distance calculation unit is configured to calculate a travel distance between a current position of the vehicle to be detected and the stop position. The passing time calculation unit is configured to determine passing time of the vehicle to be detected according to the traffic condition type, a passing speed and the waiting time. The green wave speed calculation unit is configured to calculate the green wave speed of the vehicle to be detected according to the travel distance and the passing time.

Further, the passing time calculation unit includes a queuing passing speed determination subunit, a queuing length determination subunit and a congestion passing time determination subunit. The queuing passing speed determination subunit is configured to, in the case where the traffic condition type is a congestion traffic type, determine a pre-counted queuing passing speed as the passing speed. The queuing length determination subunit is configured to acquire a queuing length between the stop position and the intersection. The congestion passing time determination subunit is configured to calculate the passing time of the vehicle to be detected according to the waiting time, the queuing length and the queuing passing speed.

Further, the passing time calculation unit includes a maximum passing speed determination subunit, a shortest passing time determination subunit and a clear passing time determination subunit. The maximum passing speed determination subunit is configured to, in the case where the traffic condition type is a clear traffic type, determine a pre-configured maximum passing speed as the passing speed. The shortest passing time determination subunit is configured to calculate a ratio of the travel distance to the maximum passing speed, where the waiting time includes a countdown and a timing period of the indicator light. The clear passing time determination subunit is configured to determine the countdown as the passing time of the vehicle to be detected in a case where the ratio is less than or equal to the countdown, and the clear passing time determination subunit is further configured to determine a sum of the countdown and the timing period of the indicator light as the passing time of the vehicle to be detected in a case where the ratio is greater than the countdown.

Further, the position time determination module includes a traffic condition type acquisition unit and a stop position determination unit. The traffic condition type acquisition unit is configured to acquire the traffic condition type of the intersection. The stop position determination unit is configured to screen out a stop position matching with the traffic condition type from multiple pre-calculated stop positions.

Further, the stop position determination unit includes a clear stop position determination subunit. The clear stop position determination subunit is configured to, in a case where the traffic condition type is a clear traffic type, screen out the stop position according to a predicted travel direction of the vehicle to be detected, and determine the stop position as the stop position matching with the traffic condition type.

Further, the green wave speed determination apparatus further includes a path sequence acquisition module, a path sequence classification module, a congestion stop position acquisition module, a clear path sequence division module and a clear stop position acquisition module. The path sequence acquisition module is configured to acquire path sequences of historical vehicles passing through the intersection. The path sequence classification module is configured to divide the path sequences according to the traffic condition type to form a clear path sequence set and a congestion path sequence set. The congestion stop position acquisition module is configured to acquire a queue tail position of a vehicle queuing queue corresponding to a path sequence included in the congestion path sequence set, and determine a stop position matching with the congestion traffic type. The clear path sequence division module is configured to divide, in the clear path sequence set, a path sequence according to a historical travel direction of the included path sequence in the clear path sequence set. The clear stop position acquisition module is configured to determine a key point of the historical travel direction, and determine a position of the key point as the stop position matching with the clear traffic type in the path sequence corresponding to the historical travel direction.

Further, the clear stop position acquisition module includes a turning key point determination unit and a straight travelling key point determination unit. The turning key point determination unit is configured to, in the case where the historical travel direction is turning, calculate a gradient of each position point in the path sequence, and determine a position point with the maximum gradient as a key point for the turning. The straight travelling key point determination unit, which is configured to, in the case where the historical travel direction is straight travelling, acquire a travel speed of a road segment between two adjacent position points in the path sequence, and the straight travelling key point determination unit is further configured to select one of two position points between which the travel speed is minimum as a key point for the straight travelling.

Further, the position time determination module includes a travel direction prediction unit, a target indicator light determination unit and a waiting time determination unit. The travel direction prediction unit is configured to acquire a predicted travel direction of the vehicle to be detected. The target indicator light determination unit is configured to determine a target indicator light in indicator lights of the intersection according to the predicted travel direction. The waiting time determination unit is configured to acquire a timing period and/or a countdown of the target indicator light, and determine the timing period and/or the countdown as the waiting time of the indicator light at the intersection.

Further, the travel direction prediction unit includes a historical travel direction acquisition subunit, a travel direction weight calculation subunit and a travel direction determination subunit. The historical travel direction acquisition subunit is configured to acquire historical tracks of the vehicle to be detected passing through the intersection, and determine travel directions of the historical tracks. The travel direction weight calculation subunit is configured to count numbers of times that the vehicle to be detected passes through the intersection in different travel directions according to the travel directions of the historical tracks, and determine a weight of each travel direction. The travel direction determination subunit is configured to determine the predicted travel direction of the vehicle to be detected according to the weight of each travel direction.

The apparatus described above may execute the green wave speed determination method provided in any of the embodiments of the present disclosure and has corresponding functional modules and beneficial effects for performing the green wave speed determination method.

According to the embodiments of the present disclosure, the present disclosure further provides an electronic device, a readable storage medium and a computer program product.

Figure 14:
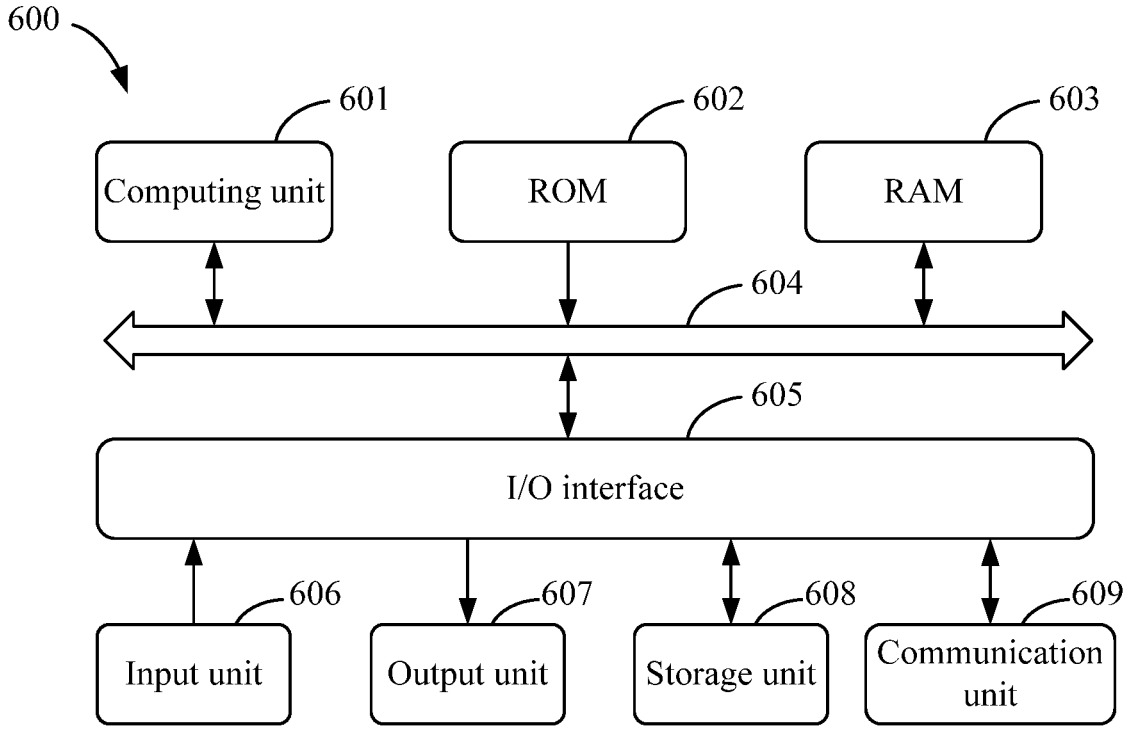
FIG. 14 is a block diagram of an electronic device to implement the green wave speed determination method in the embodiments of the present disclosure.

FIG. 14 shows a schematic block diagram of an exemplary electronic device 600 that may be used for implementing the embodiments of the present disclosure. The electronic device is intended to represent various forms of digital computers, such as laptops, desktops, workstations, personal digital assistants, servers, blade servers, mainframe computers, and other appropriate computers. The electronic device may also represent various forms of mobile devices, such as personal digital processing, cellphones, smartphones, wearable devices, and other similar computing devices. The components shown herein, their connections and relationships between these components, and the functions of these components, are illustrative only and are not intended to limit implementations of the present disclosure described and/or claimed herein.

As shown in FIG. 14, the device 600 includes a computing unit 601, the computing unit 601 may perform various appropriate actions and processes according to a computer program stored in a read-only memory (ROM) 602 or a computer program loaded from a storage unit 608 into a random-access memory (RAM) 603. The RAM 603 may also store various programs and data required for the operation of the device 600. The computing unit 601, the ROM 602, and the RAM 603 are connected via a bus 604. An input/output (I/O) interface 605 is also connected to the bus 604.

Multiple components in the device 600 are connected to the I/O interface 605, and the multiple components include an input unit 606 such as a keyboard or a mouse, an output unit 607 such as various types of displays or speakers, the storage unit 608 such as a magnetic disk or an optical disk, and a communication unit 609 such as a network card, a modem or a wireless communication transceiver. The communication unit 609 allows the device 600 to exchange information/data with other devices over a computer network such as the Internet and/or various telecommunication networks.

The computing unit 601 may be a variety of general-purpose and/or dedicated processing assemblies having processing and calculating capabilities. Some examples of the computing unit 601 include, but are not limited to, a central processing unit (CPU), a graphics processing unit (GPU), a special-purpose artificial intelligence (AI) computing chip, a computing unit executing machine learning model algorithms, a digital signal processor (DSP) and any suitable processor, controller and microcontroller. The computing unit 601 performs the various methods and processes described above, such as the green wave speed determination method. For example, in some embodiments, the green wave speed determination method may be implemented as computer software programs tangibly embodied in a machine-readable medium, such as the storage unit 608. In some embodiments, part or all of computer programs may be loaded and/or installed on the device 600 via the ROM 602 and/or the communication unit 609. When the computer program is loaded to the RAM 603 and executed by the computing unit 601, one or more steps of the green wave speed determination method described above may be executed. Alternatively, in other embodiments, the computing unit 601 may be configured, in any other suitable manners (e.g., by means of firmware), to perform the green wave speed determination method.

Various implementations of the systems and technologies described above herein may be achieved in digital electronic circuit systems, integrated circuit systems, field-programmable gate arrays (FPGAs), application-specific integrated circuits (ASICs), application-specific standard products (ASSPs), systems on chip (SOCs), complex programmable logic devices (CPLDs), computer hardware, firmware, software, and/or combinations thereof. These various implementations may include implementation in one or more computer programs, and the one or more computer programs are executable and/or interpretable on a programmable system including at least one programmable processor, the programmable processor may be a special-purpose or general-purpose programmable processor for receiving data and instructions from a memory system, at least one input device and at least one output device and transmitting data and instructions to the memory system, the at least one input device and the at least one output device.

Program codes for implementing the methods of the present disclosure may be written in any combination of one or more programming languages. These program codes may be provided for the processor or controller of a general-purpose computer, a special-purpose computer, or another programmable data processing device to enable the functions/operations specified in a flowchart and/or a block diagram to be implemented when the program codes are executed by the processor or controller. The program codes may be executed entirely on a machine, partly on the machine, as a stand-alone software package, partly on the machine and partly on a remote machine, or entirely on the remote machine or server.

In the context of the present disclosure, a machine-readable medium may be a tangible medium that may contain or store a program available for an instruction execution system, apparatus or device or a program used in conjunction with an instruction execution system, apparatus or device.

The machine-readable medium may be a machine-readable signal medium or a machine-readable storage medium. The machine-readable medium may include, but is not limited to, an electronic, magnetic, optical, electromagnetic, infrared, or semiconductor system, apparatus, or device, or any appropriate combination of the foregoing. More specific examples of the machine-readable storage medium may include an electrical connection based on one or more wires, a portable computer diskette, a hard disk, a random access memory (RAM), a read-only memory (ROM), an erasable programmable read-only memory (EPROM) or a flash memory, an optical fiber, a portable compact disc read-only memory (CD-ROM), an optical storage device, a magnetic storage device, or any appropriate combination of the foregoing.

To provide the interaction with a user, the systems and technologies described here may be implemented on a computer. The computer has a display device (e.g., a cathode-ray tube (CRT) or liquid-crystal display (LCD) monitor) for displaying information to the user; and a keyboard and a pointing device (e.g., a mouse or a trackball) through which the user may provide input to the computer. Other kinds of devices may also be used for providing for interaction with the user; for example, feedback provided to the user may be sensory feedback in any form (such as, visual feedback, auditory feedback, or haptic feedback); and input from the user may be received in any form (including acoustic input, speech input, or haptic input).

The systems and technologies described here may be implemented in a computing system including a back-end component (e.g., a data server), or a computing system including a middleware component (such as, an application server), or a computing system including a front-end component (e.g., a client computer having a graphical user interface or a web browser through which the user may interact with the implementations of the systems and technologies described herein), or a computing system including any combination of such back-end component, middleware component, or front-end component. The components of the system may be interconnected by any form or medium of digital data communication (for example, a communication network). Examples of the communication network include a local area network (LAN), a wide area network (WAN), a blockchain network and the Internet.

The computing system may include clients and servers. A client and a server are generally remote from each other and typically interact through the communication network. A relationship between the clients and the servers arises by virtue of computer programs running on respective computers and having a client-server relationship to each other. The server may be a cloud server, also referred to as a cloud computing server or a cloud host. As a host product in a cloud computing service system, the server solves the defects of difficult management and weak service scalability in a traditional physical host and a related virtual private server (VPS) service.

It should be understood that various forms of the flows shown above, reordering, adding or deleting steps may be used. For example, the steps described in the present disclosure may be executed in parallel, sequentially or in different orders as long as the desired result of the technical scheme provided in the present disclosure may be achieved. The execution sequence of these steps is not limited herein.

In the technical scheme of the present disclosure, the acquisition, storage, application of the data involved such as the vehicle position, the navigation route, the travel direction, the vehicle queue all conform to the regulations of relevant laws and regulations, and do not violate the customs of public order, for example, the data may be acquired from a public data set, or the data may be acquired from the user after the authorization of the user.

The above implementations should not be construed as limiting the protection scope of the present disclosure. It should be understood by those skilled in the art that various modifications, combinations, sub-combinations and substitutions may be made, depending on design requirements and other factors. Any modification, equivalent replacement, and improvement made within the spirit and principle of the present disclosure should be included within the protection scope of the present disclosure.

What is claimed is:

1. A green wave speed determination method, comprising:

acquiring a stop position of a to-be-detected vehicle at an intersection and waiting time of an indicator light at the intersection; and determining a green wave speed of the to-be-detected vehicle according to a traffic condition type, the stop position and the waiting time;

wherein acquiring the stop position of the to-be-detected vehicle at the intersection comprises:

acquiring the traffic condition type of the intersection; and screening out the stop position matching with the traffic condition type from a plurality of pre-calculated stop positions;

wherein before acquiring the stop position of the to-be-detected vehicle at the intersection, the method further comprises:

acquiring path sequences of historical vehicles passing through the intersection;

dividing the path sequences according to different traffic condition types to form a clear path sequence set corresponding to a clear traffic type and a congestion path sequence set corresponding to a congestion traffic type;

for each path sequence comprised in the congestion path sequence set, acquiring at least one queue tail position of a vehicle queuing queue corresponding to the path sequence, and determining a stop position matching with the congestion traffic type according to the at least one queue tail position; and for each path sequence comprised in the clear path sequence set, dividing, according to a historical travel direction of the path sequence, the path sequence into a path sequence set of a right-turning travel direction, a path sequence set of a straight-traveling direction, or a path sequence set of a left-turning travel direction;

determining a key point of the historical travel direction in the path sequence corresponding to the historical travel direction, and determining a position of the key point as a stop position matching with the clear traffic type, wherein the key point is a speed point at which a vehicle speed changes in the travel direction, wherein the key point in straight-travelling is a position of a lowest speed point; and the key point in right turning or left turning is a position of a point with a largest change.

2. The method of claim 1, wherein determining the green wave speed of the to-be-detected vehicle according to the traffic condition type, the stop position and the waiting time comprises:

calculating a travel distance between a current position of the to-be-detected vehicle and the stop position;

determining passing time of the to-be-detected vehicle according to the traffic condition type, a passing speed and the waiting time; and calculating the green wave speed of the to-be-detected vehicle according to the travel distance and the passing time.

3. The method of claim 2, wherein determining the passing time of the to-be-detected vehicle according to the traffic condition type, the passing speed and the waiting time comprises:

in a case where the traffic condition type is the congestion traffic type, determining a pre-counted queuing passing speed as the passing speed;

acquiring a queuing length between the stop position and the intersection; and calculating the passing time of the to-be-detected vehicle according to the waiting time, the queuing length and the passing speed.

4. The method of claim 2, wherein determining the passing time of the to-be-detected vehicle according to the traffic condition type, the passing speed and the waiting time comprises:

in a case where the traffic condition type is the clear traffic type, determining a pre-configured maximum passing speed as the passing speed;

calculating a ratio of the travel distance to the maximum passing speed, wherein the waiting time comprises a countdown and a timing period of the indicator light;

in a case where the ratio is less than or equal to the countdown, determining the countdown as the passing time of the to-be-detected vehicle; and in a case where the ratio is greater than the countdown, determining a sum of the countdown and the timing period of the indicator light as the passing time of the to-be-detected vehicle.

5. The method of claim 1, wherein screening out the stop position matching with the traffic condition type comprises:

in a case where the traffic condition type is the clear traffic type, screening out a stop position according to a predicted travel direction of the to-be-detected vehicle, and determining the stop position as the stop position matching with the traffic condition type.

6. The method of claim 1, wherein determining the key point of the historical travel direction comprises:

in a case where the historical travel direction is turning, calculating a gradient of each position point in the path sequence, and determining a position point with a maximum gradient as a key point of the turning;

in a case where the historical travel direction is straight travelling, acquiring a travel speed of a road segment between two adjacent position points in the path sequence; and selecting one of two position points between which the travel speed is minimum as a key point of the straight travelling.

7. The method of claim 1, wherein acquiring the waiting time of the indicator light at the intersection comprises:

acquiring a predicted travel direction of the to-be-detected vehicle;

determining a target indicator light in indicator lights of the intersection according to the predicted travel direction; and acquiring at least one of a timing period or a countdown of the target indicator light, and determining the at least one of the timing period or the countdown as the waiting time of the indicator light at the intersection.

8. The method of claim 7, wherein acquiring the predicted travel direction of the to-be-detected vehicle comprises:

acquiring historical tracks of the to-be-detected vehicle passing through the intersection, and determining travel directions of the historical tracks;

counting numbers of times that the to-be-detected vehicle passes through the intersection in different travel directions according to the travel directions of the historical tracks, and determining a weight of each of the different travel directions; and determining the predicted travel direction of the to-be-detected vehicle according to the weight of each of the different travel directions.

9. An electronic device, comprising:

at least one processor; and a memory communicatively connected to the at least one processor;

wherein the memory stores an instruction executable by the at least one processor, and the instruction, when executed by the at least one processor, causes the at least one processor to perform the following steps:

acquiring a stop position of a to-be-detected vehicle at an intersection and waiting time of an indicator light at the intersection; and determining a green wave speed of the to-be-detected vehicle according to a traffic condition type, the stop position and the waiting time;

wherein the at least one processor is caused to perform acquiring the stop position of the to-be-detected vehicle at the intersection by:

acquiring the traffic condition type of the intersection; and screening out the stop position matching with the traffic condition type from a plurality of pre-calculated stop positions;

wherein the at least one processor is caused to further perform the following:

acquiring path sequences of historical vehicles passing through the intersection;

dividing the path sequences according to different traffic condition types to form a clear path sequence set corresponding to a clear traffic type and a congestion path sequence set corresponding to a congestion traffic type;

for each path sequence comprised in the congestion path sequence set, acquiring at least one queue tail position of a vehicle queuing queue corresponding to the path sequence, and determining a stop position matching with the congestion traffic type according to the at least one queue tail position; and for each path sequence comprised in the clear path sequence set, dividing, according to a historical travel direction of the path sequence, the path sequence into a path sequence set of a right-turning travel direction, a path sequence set of a straight-traveling direction, or a path sequence set of a left-turning travel direction;

determining a key point of the historical travel direction in the path sequence corresponding to the historical travel direction, and determining a position of the key point as a stop position matching with the clear traffic type, wherein the key point is a speed point at which a vehicle speed changes in the travel direction, wherein the key point in straight-travelling is a position of a lowest speed point; and the key point in right turning or left turning is a position of a point with a largest change.

10. The electronic device of claim 9, wherein the at least one processor is caused to perform determining the green wave speed of the to-be-detected vehicle according to the traffic condition type, the stop position and the waiting time by:

calculating a travel distance between a current position of the to-be-detected vehicle and the stop position;

determining passing time of the to-be-detected vehicle according to the traffic condition type, a passing speed and the waiting time; and calculating the green wave speed of the to-be-detected vehicle according to the travel distance and the passing time.

11. The electronic device of claim 10, wherein the at least one processor is caused to perform determining the passing time of the to-be-detected vehicle according to the traffic condition type, the passing speed and the waiting time by:

in a case where the traffic condition type is the congestion traffic type, determining a pre-counted queuing passing speed as the passing speed;

acquiring a queuing length between the stop position and the intersection; and calculating the passing time of the to-be-detected vehicle according to the waiting time, the queuing length and the passing speed.

12. The electronic device of claim 10, wherein the at least one processor is caused to perform determining the passing time of the to-be-detected vehicle according to the traffic condition type, the passing speed and the waiting time by:

in a case where the traffic condition type is the clear traffic type, determining a pre-configured maximum passing speed as the passing speed;

calculating a ratio of the travel distance to the maximum passing speed, wherein the waiting time comprises a countdown and a timing period of the indicator light;

in a case where the ratio is less than or equal to the countdown, determining the countdown as the passing time of the to-be-detected vehicle; and in a case where the ratio is greater than the countdown, determining a sum of the countdown and the timing period of the indicator light as the passing time of the to-be-detected vehicle.

13. The electronic device of claim 9, wherein the at least one processor is caused to perform screening out the stop position matching with the traffic condition type by:

in a case where the traffic condition type is a clear traffic type, screening out a stop position according to a predicted travel direction of the to-be-detected vehicle, and determining the stop position as the stop position matching with the traffic condition type.

14. The electronic device of claim 9, wherein the at least one processor is caused to perform determining the key point of the historical travel direction by:

in a case where the historical travel direction is turning, calculating a gradient of each position point in the path sequence, and determining a position point with a maximum gradient as a key point of the turning;

in a case where the historical travel direction is straight travelling, acquiring a travel speed of a road segment between two adjacent position points in the path sequence; and selecting one of two position points between which the travel speed is minimum as a key point of the straight travelling.

15. The electronic device of claim 9, wherein the at least one processor is caused to perform acquiring the waiting time of the indicator light at the intersection by:

acquiring a predicted travel direction of the to-be-detected vehicle;

determining a target indicator light in indicator lights of the intersection according to the predicted travel direction; and acquiring at least one of a timing period or a countdown of the target indicator light, and determining the at least one of the timing period or the countdown as the waiting time of the indicator light at the intersection;

wherein the at least one processor is caused to perform acquiring the predicted travel direction of the to-be-detected vehicle by:

acquiring historical tracks of the to-be-detected vehicle passing through the intersection, and determining travel directions of the historical tracks;

counting numbers of times that the to-be-detected vehicle passes through the intersection in different travel directions according to the travel directions of the historical tracks, and determining a weight of each of the different travel directions; and determining the predicted travel direction of the to-be-detected vehicle according to the weight of each of the different travel directions.

16. A non-transitory computer-readable storage medium storing a computer instruction, wherein the computer instruction is configured to cause a computer to perform the following steps:

acquiring a stop position of a to-be-detected vehicle at an intersection and waiting time of an indicator light at the intersection; and determining a green wave speed of the to-be-detected vehicle according to a traffic condition type, the stop position and the waiting time;

wherein the computer is caused to perform acquiring the stop position of the to-be-detected vehicle at the intersection by:

acquiring the traffic condition type of the intersection; and screening out the stop position matching with the traffic condition type from a plurality of pre-calculated stop positions;

wherein the computer is caused to further perform the following:

acquiring path sequences of historical vehicles passing through the intersection;

dividing the path sequences according to different traffic condition types to form a clear path sequence set corresponding to a clear traffic type and a congestion path sequence set corresponding to a congestion traffic type;

for each path sequence comprised in the congestion path sequence set, acquiring at least one queue tail position of a vehicle queuing queue corresponding to the path sequence, and determining a stop position matching with the congestion traffic type according to the at least one queue tail position; and for each path sequence comprised in the clear path sequence set, dividing, according to a historical travel direction of the path sequence, the path sequence into a path sequence set of a right-turning travel direction, a path sequence set of a straight-traveling direction, or a path sequence set of a left-turning travel direction;

determining a key point of the historical travel direction in the path sequence corresponding to the historical travel direction, and determining a position of the key point as a stop position matching with the clear traffic type, wherein the key point is a speed point at which a vehicle speed changes in the travel direction, wherein the key point in straight-travelling is a position of a lowest speed point; and the key point in right turning or left turning is a position of a point with a largest change.

17. The storage medium of claim 16, wherein the computer is caused to perform determining the green wave speed of the to-be-detected vehicle according to the traffic condition type, the stop position and the waiting time by:

calculating a travel distance between a current position of the to-be-detected vehicle and the stop position;

determining passing time of the to-be-detected vehicle according to the traffic condition type, a passing speed and the waiting time; and calculating the green wave speed of the to-be-detected vehicle according to the travel distance and the passing time.

18. The storage medium of claim 17, wherein the computer is caused to perform determining the passing time of the to-be-detected vehicle according to the traffic condition type, the passing speed and the waiting time by:

in a case where the traffic condition type is the congestion traffic type, determining a pre-counted queuing passing speed as the passing speed;

acquiring a queuing length between the stop position and the intersection; and calculating the passing time of the to-be-detected vehicle according to the waiting time, the queuing length and the passing speed.

19. The storage medium of claim 17, wherein the computer is caused to perform determining the passing time of the to-be-detected vehicle according to the traffic condition type, the passing speed and the waiting time by:

in a case where the traffic condition type is the clear traffic type, determining a pre-configured maximum passing speed as the passing speed;

calculating a ratio of the travel distance to the maximum passing speed, wherein the waiting time comprises a countdown and a timing period of the indicator light;

in a case where the ratio is less than or equal to the countdown, determining the countdown as the passing time of the to-be-detected vehicle; and in a case where the ratio is greater than the countdown, determining a sum of the countdown and the timing period of the indicator light as the passing time of the to-be-detected vehicle.

20. The storage medium of claim 16, wherein the computer is caused to perform screening out the stop position matching with the traffic condition type by:

in a case where the traffic condition type is a clear traffic type, screening out a stop position according to a predicted travel direction of the to-be-detected vehicle, and determining the stop position as the stop position matching with the traffic condition type.

* * * * *